US009664478B2

(12) United States Patent
Robinson et al.

(10) Patent No.: US 9,664,478 B2
(45) Date of Patent: May 30, 2017

(54) ADJUSTABLE FIREARM STOCK

(71) Applicant: RMDI, LLC, North Salt Lake, UT (US)

(72) Inventors: Alexander J. Robinson, Salt Lake City, UT (US); Chad Larry Meeks, Clinton, UT (US)

(73) Assignee: RMDI, LLC, North Salt Lake, UT (US)

( * ) Notice: Subject to any disclaimer, the term of this patent is extended or adjusted under 35 U.S.C. 154(b) by 52 days.

(21) Appl. No.: 13/651,411

(22) Filed: Oct. 13, 2012

(65) Prior Publication Data

US 2016/0084612 A1 Mar. 24, 2016

(51) Int. Cl.
*F41C 23/00* (2006.01)
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/04; F41C 23/14; F41C 23/20; F41C 23/10; F41C 23/12; F41A 11/04
USPC ..... 42/73
See application file for complete search history.

(56) References Cited

U.S. PATENT DOCUMENTS 179,075 A * 6/1876 Smith ..... F41C 23/14 42/73
190,033 A * 4/1877 Hartley ..... F41C 23/14 42/73
543,138 A * 7/1895 Murray ..... F41C 23/04 42/71.01
669,871 A * 3/1901 Zoeller ..... F41C 23/14 42/73
729,030 A * 5/1903 Yount ..... F41C 23/14 42/73
737,732 A * 9/1903 Gaut ..... F41C 23/16 42/71.01
1,063,061 A * 5/1913 Pickering ..... F41C 23/14 42/73
1,088,362 A * 2/1914 Perkins ..... F41C 23/08 42/73
1,248,029 A * 11/1917 Mantha et al. ..... F41C 23/14 42/73
1,582,395 A * 4/1926 Haemmerli ..... F41C 23/14 42/73
1,651,299 A * 11/1927 Stansel ..... F41C 23/14 42/73

(Continued)

FOREIGN PATENT DOCUMENTS

DE 102006059914 A1 7/2007

OTHER PUBLICATIONS

English Translation of DE102006059914 to Hans Richard Rappenhoener published on Jul. 5, 2007.

*Primary Examiner* — Michelle R Clement
(74) *Attorney, Agent, or Firm* — Richard K. C. Chang, II

(57) ABSTRACT

A stock for a firearm includes an attachment member shaped to attach the stock to a firearm, a stock member pivotally attached to the attachment member so that the stock member is pivotable between an aligned position and a folded position, and a stock body. One of the stock member and stock body includes a plurality of stock attachment locations so that the stock member and stock body are connected together at one of the plurality of stock attachment locations.

13 Claims, 7 Drawing Sheets

(56) References Cited

U.S. PATENT DOCUMENTS 1,869,086 A * 7/1932 Ash ..... F41C 23/14 42/73
2,437,548 A * 3/1948 Patchett ..... F41A 11/04 42/72
2,669,051 A * 2/1954 Cline ..... F41C 23/14 42/71.01
2,787,855 A * 4/1957 Guymon ..... F41C 23/14 42/73
2,790,262 A * 4/1957 Baker ..... F41C 23/14 42/73
3,256,632 A * 6/1966 Beretta ..... F41C 23/00 42/72
3,369,316 A * 2/1968 Miller ..... F41C 23/04 42/72
3,710,496 A * 1/1973 Packmayr ..... F41C 23/14 42/71.01
4,296,566 A * 10/1981 Campos ..... F41C 23/14 42/71.01
4,383,384 A * 5/1983 Fox ..... F41C 23/04 42/72
4,589,219 A * 5/1986 Milliman ..... F41C 23/14 42/73
4,691,462 A * 9/1987 Mattarelli ..... F41C 7/11 42/73
4,766,800 A * 8/1988 Miller ..... F41A 9/59 42/49.01
4,769,938 A * 9/1988 Chesnut ..... F41A 21/484 42/124
4,788,785 A * 12/1988 White ..... F41C 23/04 42/72
4,896,446 A * 1/1990 Gregory ..... F41C 23/14 42/72
5,009,021 A * 4/1991 Nelson ..... F41C 23/20 42/73
5,031,348 A * 7/1991 Carey ..... F41C 23/14 42/71.01
5,235,764 A * 8/1993 Perazzi ..... F41C 23/14 42/1.01
5,392,553 A * 2/1995 Carey ..... F41C 23/14 42/73
5,711,102 A * 1/1998 Plaster ..... F41C 23/00 42/71.01
5,933,997 A 8/1999 Barrett
6,032,397 A 3/2000 Iannetta
6,591,533 B2 * 7/2003 Wygant ..... F41C 23/04 16/327
6,901,691 B1 * 6/2005 Little ..... F41A 23/02 42/118
7,024,812 B2 * 4/2006 Nelson ..... F41G 1/00 42/73
7,162,822 B1 * 1/2007 Heayn ..... F41C 23/04 42/71.01
7,162,823 B2 * 1/2007 Schoppman ..... F41A 11/04 42/75.01
7,337,573 B1 * 3/2008 DiGiovanna ..... F41C 23/04 42/71.01
D567,895 S 4/2008 Cauley
7,398,616 B1 * 7/2008 Weir ..... F41C 23/04 42/71.01
7,418,797 B1 * 9/2008 Crose ..... F41C 23/14 42/71.01
7,428,794 B2 * 9/2008 Oz ..... F41A 23/02 42/73
7,552,557 B1 * 6/2009 Mabry ..... F41A 11/04 42/71.01
D603,013 S * 10/2009 Fitzpatrick ..... D22/108
7,640,688 B2 * 1/2010 Oz ..... F41C 23/14 42/71.01
7,673,412 B2 * 3/2010 Griffin ..... F41C 23/04 42/71.01
7,673,413 B2 * 3/2010 Bentley ..... F41C 23/06 42/72
7,762,018 B1 * 7/2010 Fitzpatrick ..... F41A 11/02 42/73
7,793,453 B1 * 9/2010 Sewell, Jr. ..... F41C 23/04 42/73
7,805,873 B2 * 10/2010 Bentley ..... F41C 23/14 42/71.01
7,810,270 B2 * 10/2010 Fitzpatrick ..... F41A 21/481 42/71.01
7,827,721 B2 * 11/2010 Griffin ..... F41C 23/04 42/71.01
7,849,626 B2 * 12/2010 Fluhr ..... F41C 23/04 42/73
D634,388 S * 3/2011 Peterson ..... D22/108
D636,833 S * 4/2011 Mayberry ..... D22/108
D636,834 S * 4/2011 Mayberry ..... D22/108
7,930,849 B2 * 4/2011 Abraham ..... F41C 23/14 42/73
7,966,761 B1 * 6/2011 Kuczynko ..... F41C 23/04 42/73
7,984,580 B1 * 7/2011 Giauque ..... F41C 23/06 42/73
D645,533 S * 9/2011 Peterson ..... D22/108
8,087,193 B2 * 1/2012 Kincel ..... F41C 23/04 42/71.01
8,245,429 B2 * 8/2012 Kuczynko ..... F41C 23/04 42/73
8,296,986 B1 * 10/2012 Cook ..... F41A 25/10 42/71.01
8,312,661 B2 * 11/2012 Ludlow ..... F41C 23/04 42/73
8,381,427 B2 * 2/2013 Nill ..... F41C 23/04 42/71.01
8,387,298 B2 * 3/2013 Kincel ..... F41C 23/04 42/71.01
8,402,683 B2 * 3/2013 Cabahug ..... F41C 23/04 42/71.01
8,429,843 B2 * 4/2013 Yan ..... F41C 23/12 42/71.01
8,429,844 B2 * 4/2013 Dextraze ..... F41A 3/18 42/73
8,453,365 B1 * 6/2013 Ballard ..... F41C 23/14 42/71.01
8,464,458 B2 * 6/2013 Chvala ..... F41C 23/04 42/73
8,522,465 B2 * 9/2013 Jarboe ..... F41A 3/18 42/16
8,631,601 B2 * 1/2014 Langevin ..... F41C 23/04 42/73
8,656,622 B2 * 2/2014 Peterson ..... F41A 11/02 42/124
D704,294 S * 5/2014 Jarboe ..... D22/108
8,763,296 B1 * 7/2014 Chvala ..... F41C 23/14 42/73
8,769,854 B1 * 7/2014 Battaglia ..... F41A 3/66 42/71.01
8,769,855 B2 * 7/2014 Law ..... F41C 23/14 42/73
8,776,423 B2 * 7/2014 Paquette ..... F41C 23/14 42/73
8,844,185 B2 * 9/2014 Jarboe ..... F41C 23/04 42/73
8,915,005 B2 * 12/2014 Grimshaw ..... F41C 23/04 42/73
8,925,234 B1 * 1/2015 Barrett ..... F41A 3/22 42/14
8,955,245 B2 * 2/2015 Chvala ..... F41C 23/14 42/1.06
8,978,285 B1 * 3/2015 Burke ..... F41C 23/14 42/73
8,984,790 B2 * 3/2015 Wilson ..... F41C 23/14 42/73
8,991,088 B1 * 3/2015 Young ..... F41A 25/00 42/75.03
9,228,795 B1 * 1/2016 Kielsmeier ..... F41C 23/14
2005/0115140 A1 * 6/2005 Little ..... F41A 23/02 42/118

(56) References Cited

U.S. PATENT DOCUMENTS

2005/0268516 A1* 12/2005 Nelson ..... F41G 1/00 42/73
2006/0010749 A1* 1/2006 Kincel ..... F41C 23/22 42/71.01
2006/0096146 A1* 5/2006 Fitzpatrick ..... F41C 23/04 42/71.01
2006/0174532 A1* 8/2006 Popikow ..... F41C 23/14 42/73
2006/0242880 A1* 11/2006 Griffin ..... F41C 23/04 42/73
2006/0254111 A1* 11/2006 Giauque ..... F41C 23/14 42/72
2007/0056202 A1* 3/2007 Oz ..... F41A 23/02 42/94
2007/0101631 A1* 5/2007 Bentley ..... F41C 23/14 42/74
2007/0214697 A1* 9/2007 Ochoa ..... F41C 23/14 42/73
2007/0289190 A1* 12/2007 Oz ..... F41C 23/14 42/73
2008/0000132 A1 1/2008 Orvis
2008/0028662 A1* 2/2008 Abraham ..... F41C 23/14 42/73
2008/0236017 A1* 10/2008 Fitzpatrick ..... F41A 21/481 42/73
2009/0139128 A1* 6/2009 Fluhr ..... F41C 23/04 42/71.01
2009/0288324 A1* 11/2009 Peterson ..... F41A 11/02 42/75.03
2010/0115817 A1* 5/2010 Faifer ..... F41C 23/06 42/71.01
2010/0212205 A1* 8/2010 Nill ..... F41C 23/14 42/73
2010/0212206 A1* 8/2010 Griffin ..... F41C 23/04 42/73
2010/0229444 A1* 9/2010 Faifer ..... F41C 23/04 42/1.06
2010/0242333 A1* 9/2010 Kincel ..... F41C 23/04 42/73
2010/0242334 A1* 9/2010 Kincel ..... F41C 23/04 42/74
2010/0307042 A1* 12/2010 Jarboe ..... F41A 3/18 42/6
2011/0131857 A1* 6/2011 Kuczynko ..... F41A 3/84 42/73
2011/0283584 A1* 11/2011 Walters ..... F41C 23/04 42/73
2012/0030983 A1* 2/2012 Kuczynko ..... F41A 3/84 42/73
2012/0047786 A1* 3/2012 Dextraze ..... F41A 3/18 42/18
2012/0137561 A1* 6/2012 Ludlow ..... F41C 23/04 42/75.03
2012/0137562 A1* 6/2012 Langevin ..... F41C 23/04 42/75.03
2012/0186124 A1* 7/2012 Kincel ..... F41C 23/04 42/74
2013/0036645 A1* 2/2013 Chvala ..... F41C 23/04 42/73
2013/0097911 A1* 4/2013 Larue ..... F41C 23/04 42/73
2013/0180148 A1* 7/2013 Rogers ..... F41C 23/04 42/73
2013/0212920 A1* 8/2013 Law ..... F41C 23/14 42/75.03
2014/0075815 A1* 3/2014 Jarboe ..... F41C 23/04 42/73
2014/0109453 A1* 4/2014 Paquette ..... F41C 23/14 42/73
2014/0196343 A1* 7/2014 Wilson ..... F41C 23/14 42/71.01
2014/0196345 A1* 7/2014 Grimshaw ..... F41C 23/04 42/73
2014/0196346 A1* 7/2014 Grimshaw ..... F41C 23/04 42/73
2014/0223793 A1* 8/2014 Peterson ..... F41A 11/02 42/71.01
2014/0245649 A1* 9/2014 Fluhr ..... F41C 23/14 42/73
2014/0259848 A1* 9/2014 Chvala ..... F41C 23/14 42/73
2014/0360074 A1* 12/2014 Jarboe ..... F41C 23/04 42/73
2015/0007476 A1* 1/2015 Dextraze ..... F41G 11/003 42/71.01
2015/0052795 A1* 2/2015 Burke ..... F41C 23/14 42/71.01
2015/0075051 A1* 3/2015 Law ..... F41C 23/14 42/75.03
2015/0113848 A1* 4/2015 Monveldt ..... F41C 23/04 42/16
2015/0176944 A1* 6/2015 Kupanoff ..... F41C 23/12 42/73
2015/0176945 A1* 6/2015 Simek ..... F41A 3/64 42/75.03
2015/0276343 A1* 10/2015 Zusman ..... F41C 23/04 42/71.01
2015/0316346 A1* 11/2015 Brandt ..... F41C 23/12 42/71.02
2015/0338186 A1* 11/2015 Hopkins ..... F41C 23/14 42/73
2015/0377584 A1* 12/2015 Chvala ..... F41C 23/16 42/75.01
2016/0018184 A1* 1/2016 Park ..... F41C 23/20 42/73
2016/0116250 A1* 4/2016 Mather ..... F41A 3/66 42/73
2016/0178314 A1* 6/2016 Kielsmeier ..... F41C 23/20 42/73
2016/0202016 A1* 7/2016 Mather ..... F41C 23/14 42/73

* cited by examiner

ADJUSTABLE FIREARM STOCK

TECHNICAL FIELD

The present disclosure relates generally to firearms. More particularly, the disclosure relates to an adjustable stock for firearms.

BACKGROUND

Several firearm stocks are currently available that allow a user to support a firearm. However, currently available stocks may interfere with or fail to support a user's sighting through the optics or sights of a firearm. In spite of the different stocks available, there is still a need for new stock designs that better fit a user's body, clothing, and accessories. Some sock designs such as US patent application publication no. 2008/0000132 uses a dogleg design to allow a user to position their head in-line with the sight of the gun. Other examples of stock designs include U.S. design Pat. Nos. D636,834 and D603,013 which show variations of folding firearm stocks. Other examples include U.S. Pat. No. 7,673,412, U.S. Pat. No. 7,827,721, and U.S. Pat. No. 4,788,785. U.S. Pat. No. 7,640,688 discloses an adjustable cheek rest whose cheek rest comb is adjustable both longitudinally and vertically with respect to the butt stock to suit the needs of a particular shooter. Other examples include U.S. Pat. No. 7,428,794, U.S. Pat. No. 5,933,997, U.S. Pat. No. 6,032,397, U.S. design Pat. No. D567,895, and German patent application DE102006059914.

SUMMARY OF THE INVENTION

In one aspect of the disclosure, a stock for a firearm includes an attachment member shaped to attach the stock to a firearm and a stock member pivotally attached to the attachment member so that the stock member is pivotable between an aligned position and a folded position. The stock further includes a stock body. One of the stock member and stock body includes a plurality of stock attachment locations so that the stock member and stock body are connected together at one of the plurality of stock attachment locations.

In another aspect that may be combined with any of the aspects herein, the plurality of stock attachment locations may be a plurality of vertically oriented holes.

In another aspect that may be combined with any of the aspects herein, the plurality of stock attachment locations may be disposed in a recessed surface of the stock member.

In another aspect that may be combined with any of the aspects herein, the stock may include a fastener extending through the stock member into the stock body to connect the stock body to the stock member.

In another aspect that may be combined with any of the aspects herein, the stock body may be an assembly including a housing including a plurality of channels, a telescoping frame fixable at one of a plurality of housing positions, and a cheek piece including a protrusion. The protrusion may be disposed in one of the plurality of channels to position the cheek piece at one of a plurality of heights relative to the housing.

In another aspect that may be combined with any of the aspects herein, the housing may include a cheek piece retainer disposed to selectively retain the protrusion in one of the plurality of channels.

In another aspect that may be combined with any of the aspects herein, the cheek piece retainer may include an actuation surface that is disposed beneath the outer surface of the housing.

In another aspect that may be combined with any of the aspects herein, the cheek piece retainer may be disposed to selectively prevent the telescoping frame from being disconnected from the housing.

In another aspect that may be combined with any of the aspects herein, the telescoping frame selectively moves relative to the housing along a horizontal axis of the stock body and the stock body has a vertical axis perpendicular to the horizontal axis. When the stock member is disposed in the aligned position, the abutment surface abuts the reciprocal abutment surface and the abutment surface and the reciprocal abutment surface are disposed at a negative angle relative to the axis.

In another aspect that may be combined with any of the aspects herein, the angle is in the range of 1 to 10 degrees.

In another aspect that may be combined with any of the aspects herein, the angle is in the range of 3 to 7 degrees.

In another aspect that may be combined with any of the aspects herein, the attachment member includes a sling swivel attachment feature disposed in a bottom surface of the attachment member.

In another aspect that may be combined with any of the aspects herein, the stock member is pivotally connected to the attachment member via a pin and pivots about a pivot axis, the pin including a push surface. When the stock member and the attachment member are in the aligned position and the push surface is actuated, the pin and the stock member are moved along the pivot axis to permit the stock member to be pivoted from the aligned position.

In another aspect that may be combined with any of the aspects herein, when the pin, the stock member, and stock body are moved along the pivot axis, the reciprocal abutment surface is separated from the abutment surface to permit the stock member to be pivoted from the aligned position.

DETAILED DESCRIPTION

Figure 1:
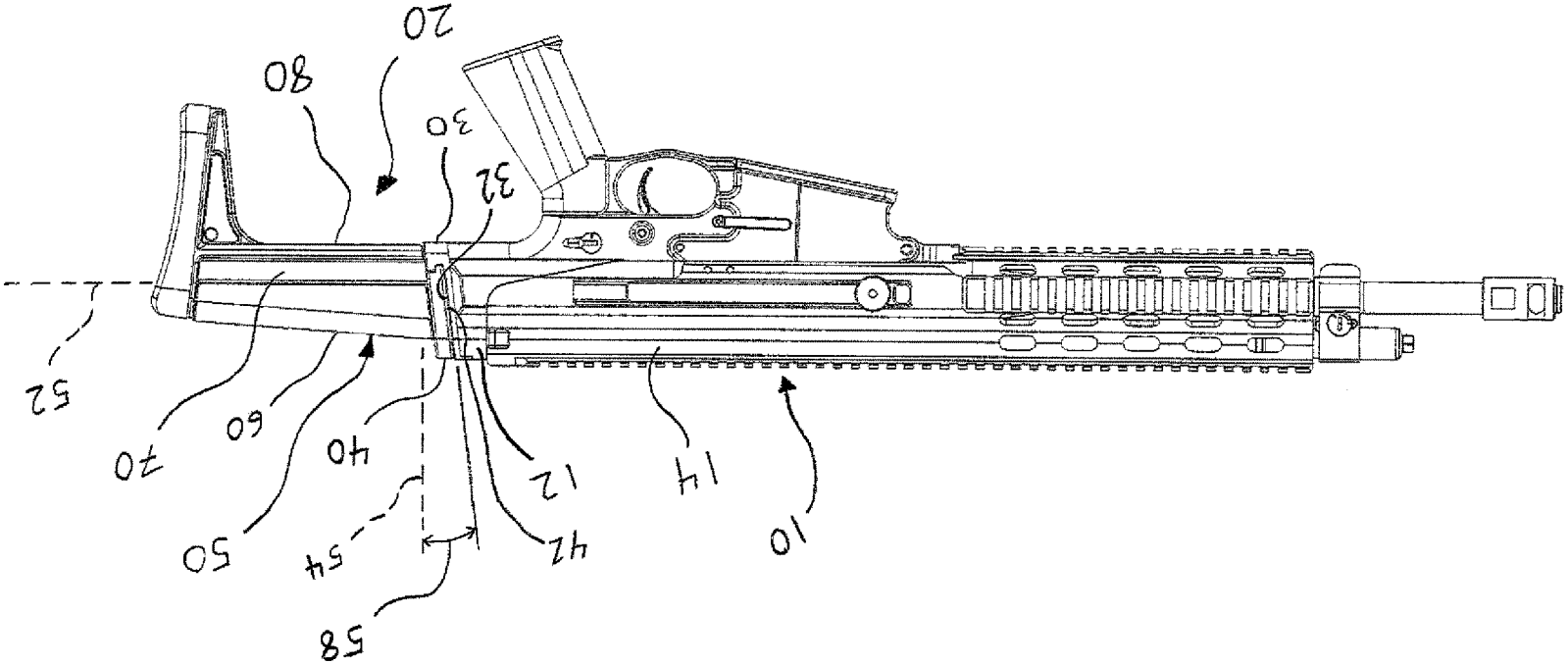
FIG. 1 illustrates a firearm having an adjustable stock.

FIG. 1 illustrates a firearm 10 that may have a lower receiver 12 and an upper receiver 14. As shown, an adjustable stock 20 is attached to the lower receiver 12.

The adjustable stock 20 includes an attachment member 30 attached to the firearm 10 and a stock member 40 that is pivotally attached to the attachment member 30. The stock member 40 is pivotable relative to the attachment member 30 between an aligned position and a folded position. As shown, the stock member 40 is disposed in the aligned position so that the stock member 40 abuts the attachment member 30. More specifically, the attachment member 30 includes an abutment surface 32 and the stock member 40 having a reciprocal abutment surface 42.

The adjustable stock 20 further includes a stock body 50. The stock body 50 includes a horizontal axis 52 that may be aligned with an axis of a barrel of the firearm 10. Perpendicular to the horizontal axis 52 is a vertical axis 54 of the stock body 50.

When the stock member 40 is disposed in the aligned position, the abutment surface 32 abuts the reciprocal abutment surface 42. In the aligned position, the abutment surface 32 and the reciprocal abutment surface 42 are disposed at a negative angle 58 relative to the vertical axis 54. In one configuration, the angle 58 is in the range of 1 to 15 degrees. In another configuration, the angle 58 is in the range of 1 to 10 degrees. In another configuration, the angle 58 is in the range of 3 to 7 degrees.

The stock body 50 may be connected to the stock member 40 at one of a plurality of heights relative to the stock member 40. Such height adjustment permits the stock 20 to be vertically adjusted to fit each specific user's needs.

The stock body 50 includes a cheek piece 60 connected to a housing 70. As will be shown in FIG. 2, the cheek piece 60 may be adjusted vertically relative to the housing 70.

Optionally, a telescoping frame 80 may be selectively fixed to the housing 70 so that the telescoping frame 80 may be selectively moved relative to the housing 70 and disposed at one of a plurality of locations along the horizontal axis 52.

Figure 2:
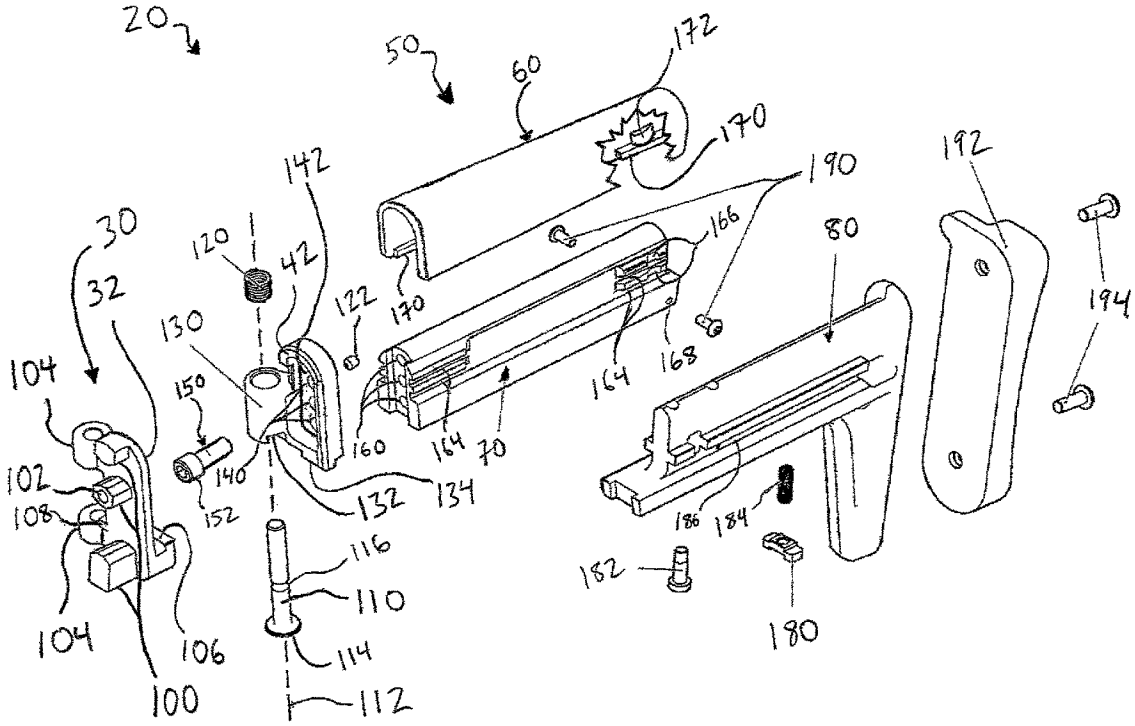
FIG. 2 illustrates an exploded view of the adjustable stock of FIG. 1.

FIG. 2 illustrates an exploded view of the adjustable stock 20. As shown, the attachment member 30 is shaped to attach the stock 20 to a firearm 10 (shown in FIG. 1) via stock attachment features 100. The stock attachment features 100 are particular to each firearm and often include a firearm attachment hole 102 that permits the attachment member 30 to be mechanically attached to a firearm.

The attachment member 30 includes one or more knuckles 104 for a pivotal connection with the stock member 40. The attachment member 30 may also include an alignment retention feature 106 and a folded retention feature 108, which will be discussed in more detail below.

When assembled, the stock member 40 is pivotally attached to the attachment member 30 via the pin 110 so that the stock member 40 the pivots about a pivot axis 112 relative to the attachment member 30 between an aligned position and a folded position. The pin includes a push surface 114 and may include a retention channel 116. When the stock member 40 and the attachment member 30 are in the aligned position and the push surface 114 is actuated, the pin 110 and the stock member 40 are moved along the pivot axis 112 to permit the stock member 40 to be pivoted from the aligned position.

A spring 120 is disposed about the pin 110 to bias the stock member 40 into engagement with the attachment member 30. The spring 120 acts to prevent unintentional disengagement of the stock member 40 from the attachment member 30 in the aligned position and in some configurations, may prevent unintentional disengagement of the stock member 40 from the attachment member 30 in the folded position.

A pin fastener 122, such as a set screw, may be disposed to engage the retention channel 116 of the pin 110 to prevent the pin 110 from being unintentionally removed from the stock member 40 and the attachment member 30.

The stock member 40 includes a knuckle 130 for assembly with the pin 110 and one or more position retention features 132 and 134. The one or more position retention features 132 may be channels disposed in the knuckle 130 to engage folded retention feature 108 of the attachment member 40 and retain the stock member 40 in a specific angular orientation about the pivot axis 112. In the configuration shown the position retention features 132 shown retains the stock 20 in the aligned position. A second position retention feature (not shown but similar to 132) disposed almost opposite the illustrated position retention features 132 on the knuckle 130 retains the stock 20 in the folded position.

The position retention feature 134 engages the alignment retention feature 106 of the attachment member 40 to securely retain the abutment surface 32 of the attachment member 30 against the reciprocal abutment surface 42 of the stock member 40 so that the stock is in the aligned position.

The stock member 40 may further include a plurality of stock attachment locations 140. As shown, plurality of stock attachment locations 140 may be vertically oriented and may be disposed in a recess 142 in the reciprocal abutment surface 42. Each of the plurality of stock attachment locations 140 may be sized to receive a fastener 150. The depth of the recess 142 may be sized to receive a head 152 of the fastener 150.

The housing 70 may include plurality of stock attachment locations 160. In connecting the stock member 40 and stock body 50 are connected together at one or more of each of the plurality of stock attachment locations 140 and 160. For example, two fasteners 150 may extend through the top and middle stock attachment locations 140 while extending through the middle and bottom stock attachment locations 160 respectively to connect the stock member 40 and stock body 50. Alternatively, a single fastener 150 may be extend through the top stock attachment location 140 while extending through the bottom stock attachment location 160 to connect the stock member 40 and stock body 50 to provide greater height adjustment of the stock body 50 relative to the attachment member 30.

The housing 70 may further include a plurality of channels 164. As shown, the rearward channels 164 may include detent recesses 166. The housing 70 may also include retention hole 168.

As shown in a partially broken view of the cheek piece 60, the cheek piece 60 includes protrusions 170 and a detent 172. When the cheek piece 60 is connected to the housing 70, the protrusion 170 is disposed in one of the plurality of channels 164 to position the cheek piece 60 at one of a plurality of heights relative to the housing 70. Further, the detent 172 of the cheek piece 60 may be disposed in one of a plurality of detent recess 166 to secure the cheek piece 60 to the housing 70 by inhibiting removal of the protrusion 170 from one of the plurality of channels 164.

Figure 3:
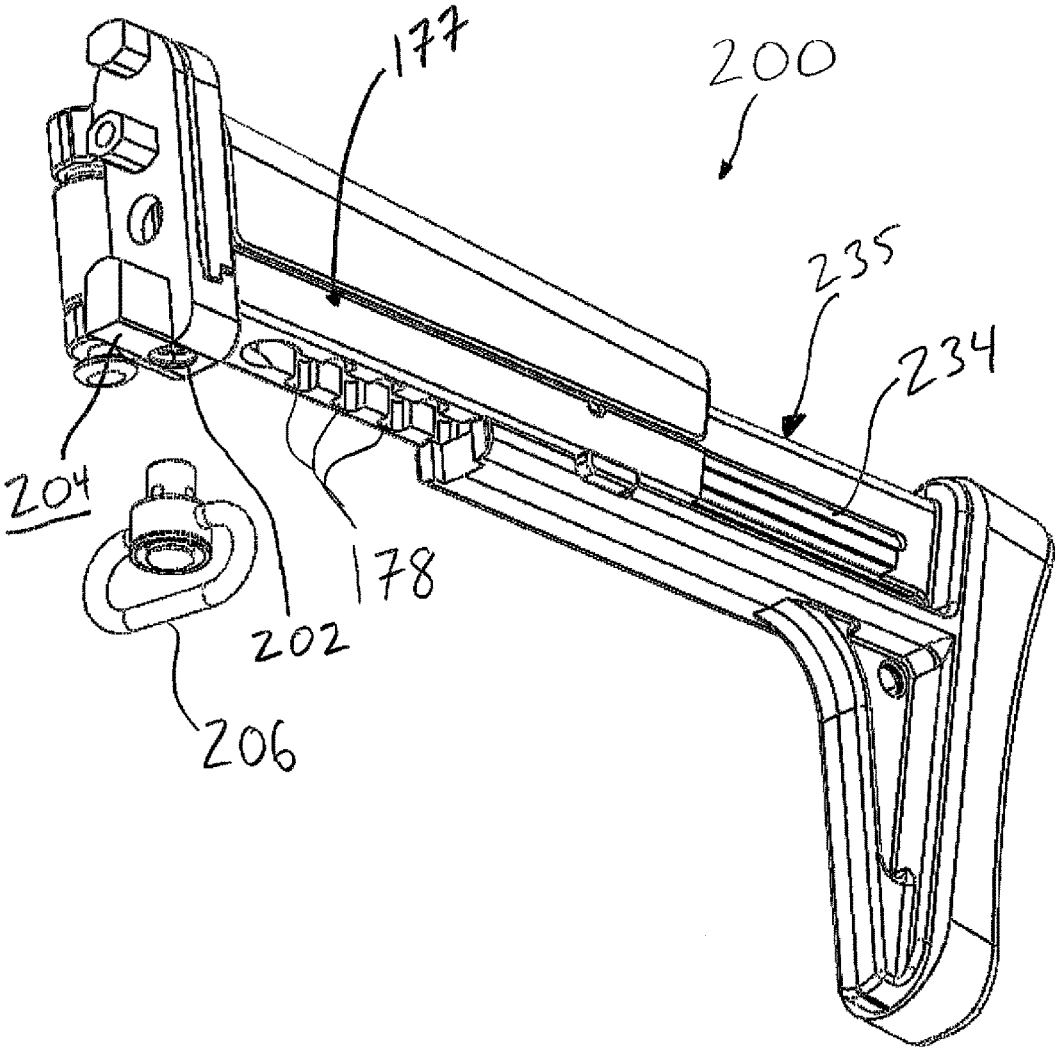
FIG. 3 illustrates an alternative configuration of an adjustable stock.

The telescoping frame 80 is disposed within the housing 70 and is selectively fixable at one of a plurality of housing positions. As shown in FIG. 3, the housing includes a plurality of connected T channels 178. The telescoping frame 80 includes a selector 180 that when actuated permits horizontal adjustment of the telescoping frame 80 relative to the housing 70 by engaging one of the T channels 178. More specifically, the selector 180 is attached to a fastener 182 that permits vertical movement of the selector 180 and is biased by a spring 184 to engagement with the one of the T channels 178. Thus, to adjust the horizontal position of the telescoping frame 80, the fastener 182 may be actuated to move the selector out of engagement with one of the T channels 178. While out of engagement, the telescoping frame 80 is moved relative to the housing 70 to the desired horizontal position and the selector is allowed to engage the new T channel 178.

The telescoping frame 80 also includes a retention groove 186. Fasteners 190 may be set in retention holes 168 in the housing 70 to be disposed in the retention groove 186. Once the fasteners 190 are removed, the telescoping frame 80 may be separated from the housing 70.

A butt stock pad 192 may be attached to the telescoping frame 80 by optional fasteners 194.

FIG. 3 illustrates an alternative configuration of an adjustable stock 200 shown in an aligned position. For brevity, the same element numbers discussed above may be used when the corresponding structures are the same in FIGS. 1 and 3. As shown, a housing 177 includes T channels 178 to permit the telescoping frame 80 to be selectively fixable at one of a plurality of housing positions.

Further, the attachment member 30 includes a sling swivel attachment feature 202 disposed in a bottom surface 204 of the attachment member 20. As shown, a sling swivel 206 may be attached to the sling swivel attachment feature 202.

Figure 4:
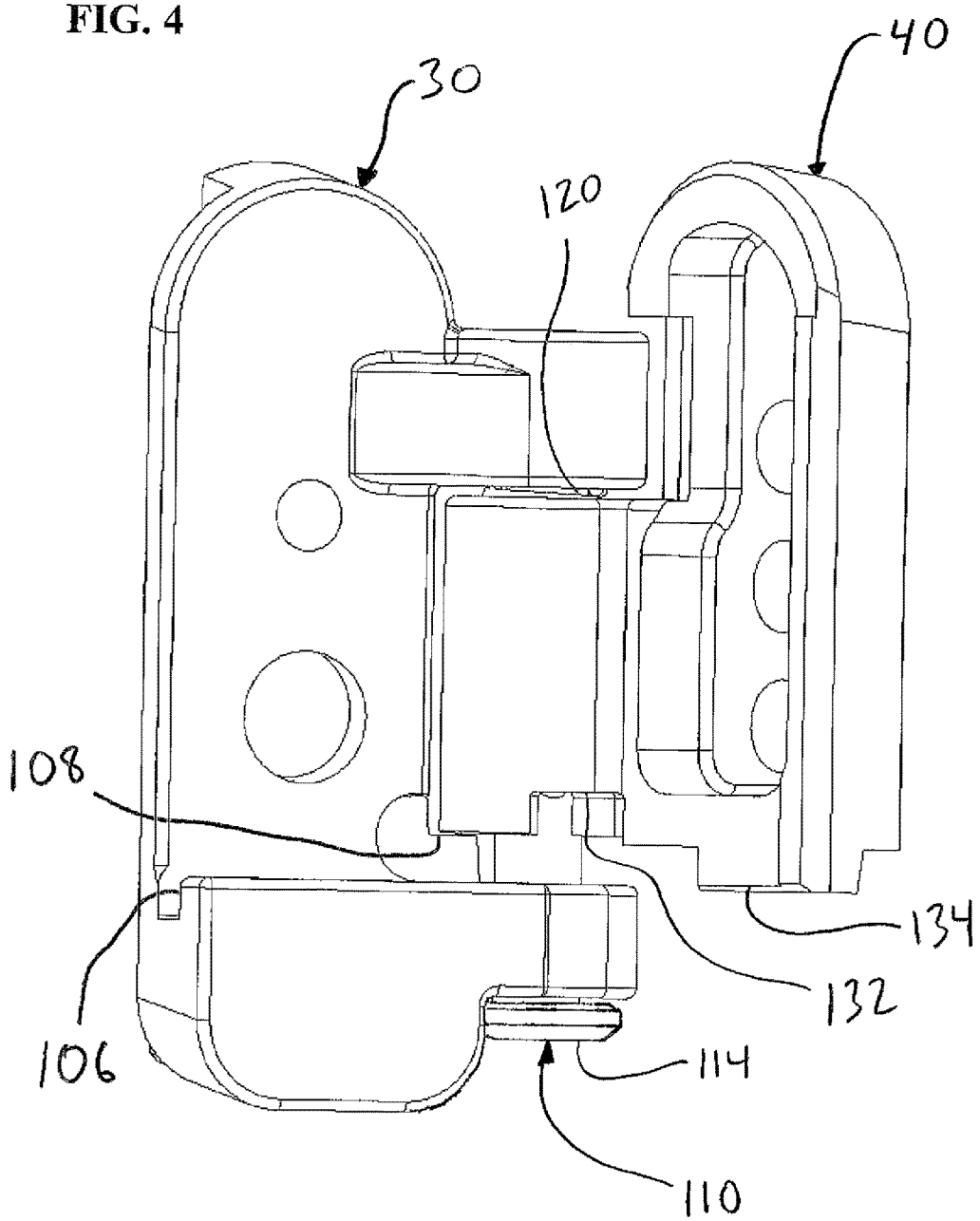
FIG. 4 illustrates a stock member pivotally attached to an attachment member via the pin shown in the configurations of FIGS. 1 and 3.

FIG. 4 illustrates the stock member 40 is pivotally attached to the attachment member 30 via the pin 110 shown in the configurations of FIGS. 1 and 3. As shown, the push surface 114 may have been actuated to compress the spring 120 and move the position retention features 132 and 134 out of engagement with the alignment retention feature 106 and the folded retention feature 108.

Figure 5:
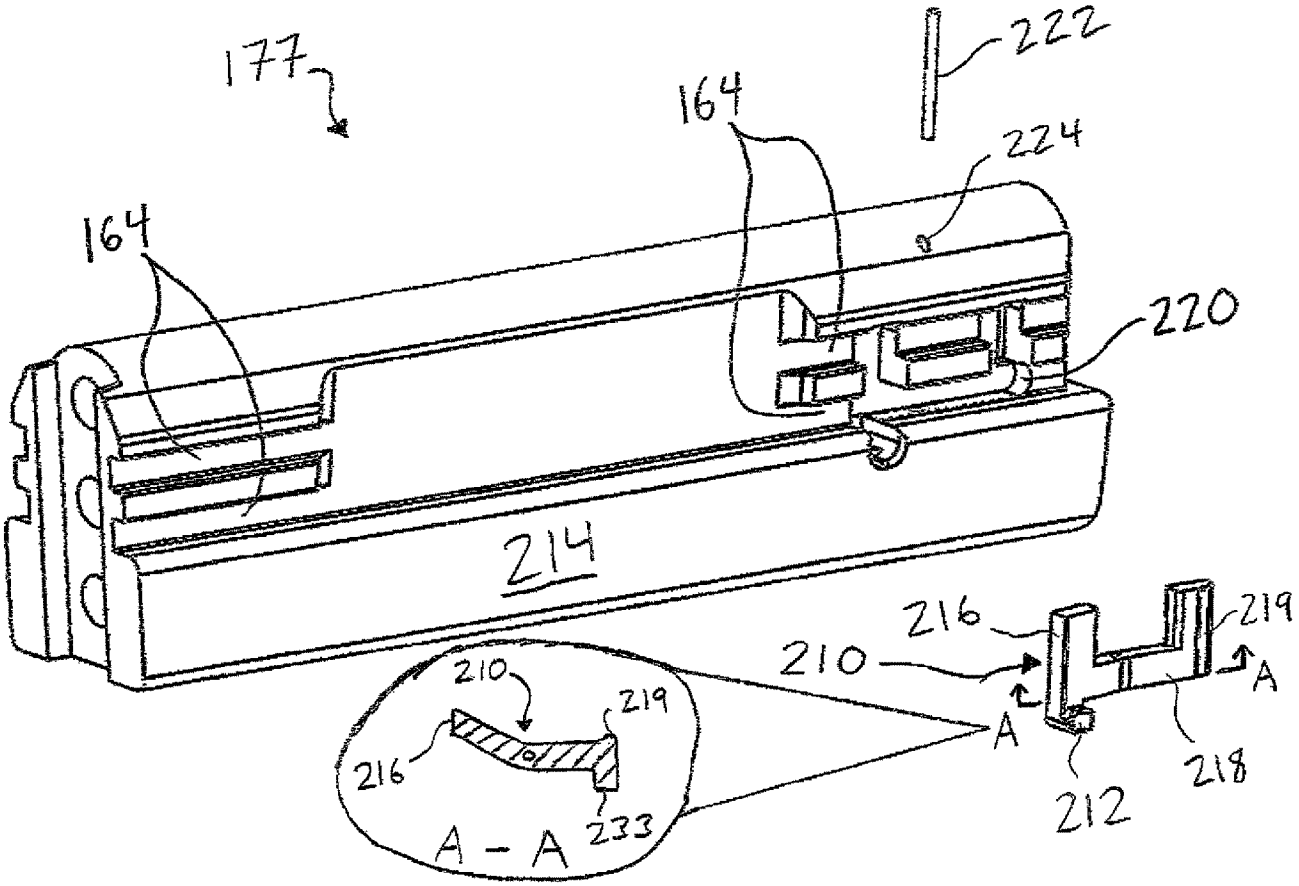
FIG. 5 illustrates an exploded view of the housing of FIG. 3.

FIG. 5 illustrates an exploded view of the housing 177 of FIG. 3. As shown, the housing 177 may include a cheek piece retainer 210 disposed to selectively retain a protrusion 230 of a cheek piece 232 (shown in FIG. 6) in at least one of the plurality of channels 164. The cheek piece retainer 210 includes an actuation surface 212 that may optionally be disposed beneath an outer surface 214 of the housing 177 and an engagement surface 216 that may be disposed to engage protrusion 230 of the cheek piece 232 (shown in FIG. 6) to secure the cheek piece 60 to the housing 177. By disposing the actuation surface 212 beneath the outer surface 214 of the housing 177, unintentional actuation may be prevented which may lead to the cheek piece 232 (shown in FIG. 6) separating from that housing 177. Alternatively, the actuation surface 212 may be disposed above the outer surface 214 of the housing 177, if convenience of adjustment is more desirable to a user.

The housing 177 includes a retainer port 220 shaped to receive the cheek piece retainer 210 and a pin 222 may be disposed in orifice 224 to pivotally connect the cheek piece retainer 210 to the housing 177. During operation, the actuation surface 212 is actuated to pivot the engagement surface 216 out of engagement with the protrusion 230 of the cheek piece 232 (shown in FIG. 6) permitting removal or repositioning the protrusion 230 of the cheek piece 232 in a different channel 164 of the housing 177.

In addition, when the cheek piece retainer 210 is engagement with the protrusion 230 of the cheek piece 232 (shown in FIG. 6), the cheek piece retainer 210 includes a projection 233 (shown in cross section A-A of FIG. 5) to selectively prevent a telescoping frame 235 from being disconnected from the housing. More specifically, the projection 233 extends into a retention groove 234 of the telescoping frame 235 (shown in FIG. 3). In this configuration, the fasteners 190 of FIG. 2 are replaced by the cheek piece retainer 210. In addition, when the cheek piece retainer 210 is retaining the telescoping frame 235, the cheek piece retainer 210 is disposed to engage the protrusion 230 of the cheek piece 232 (shown in FIG. 6).

Figure 6:
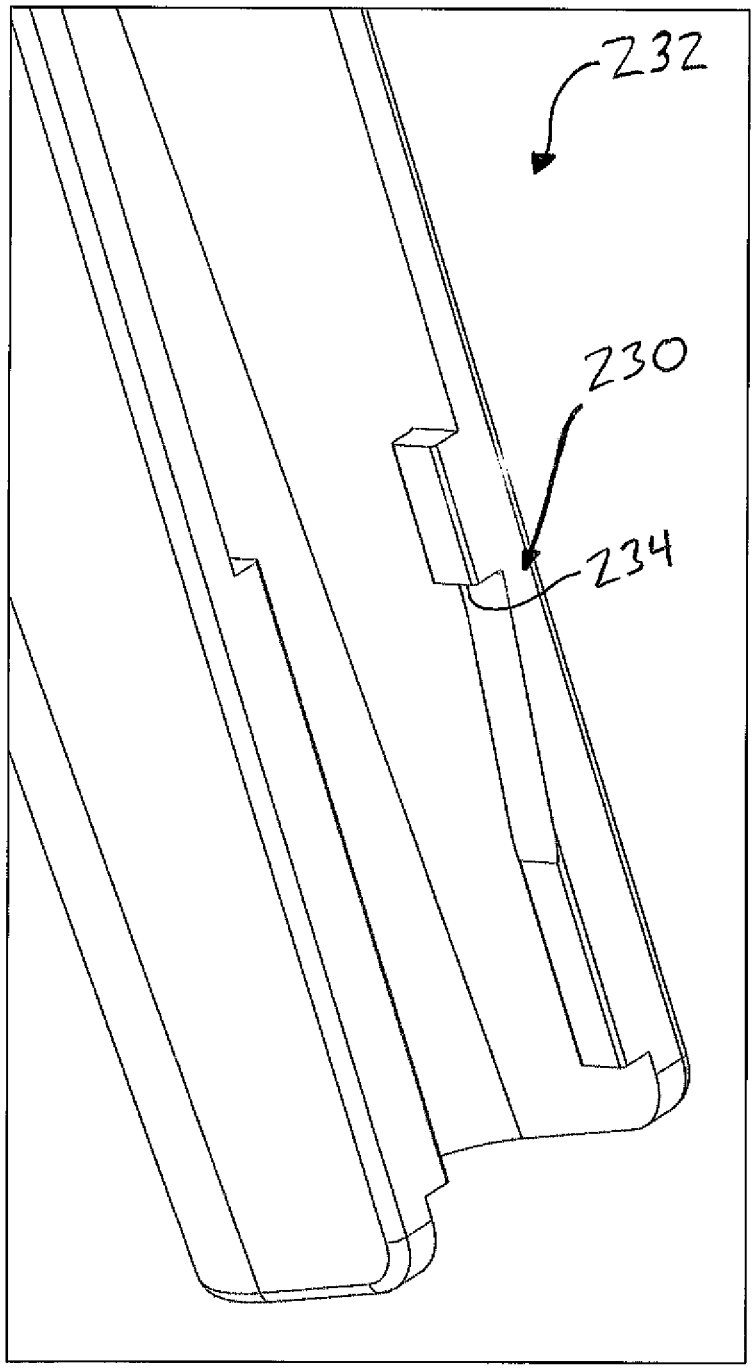
FIG. 6 illustrates an alternative configuration of a protrusion of a cheek piece for use with the housing shown in FIG. 5.

The cheek piece retainer 210 may be biased by a spring (not shown) into engagement with protrusion 230 of the cheek piece 232 (shown in FIG. 6). Alternatively, no spring is needed if the cheek piece 232 is made of a material flexible enough to engage a lever arm 218 to bias the engagement surface 216 into engagement with the protrusion 230. As shown, the lever arm 218 may include a ridge 219 to further engage the cheek piece 232 and bias the engagement surface 216 into engagement with the protrusion 230.

FIG. 6 illustrates an alternative configuration of a protrusion 230 of a cheek piece 232 for use with the housing 177 shown in FIG. 5. As shown, the protrusion 230 is shaped to receive and engage the engagement surface 216 of the cheek piece retainer 210 (shown in FIG. 5). More specifically, a locking surface 234 abuts the engagement surface 216 to retain the protrusion 230 in the channel 164 of the housing 177 (shown in FIG. 5).

Figure 7:
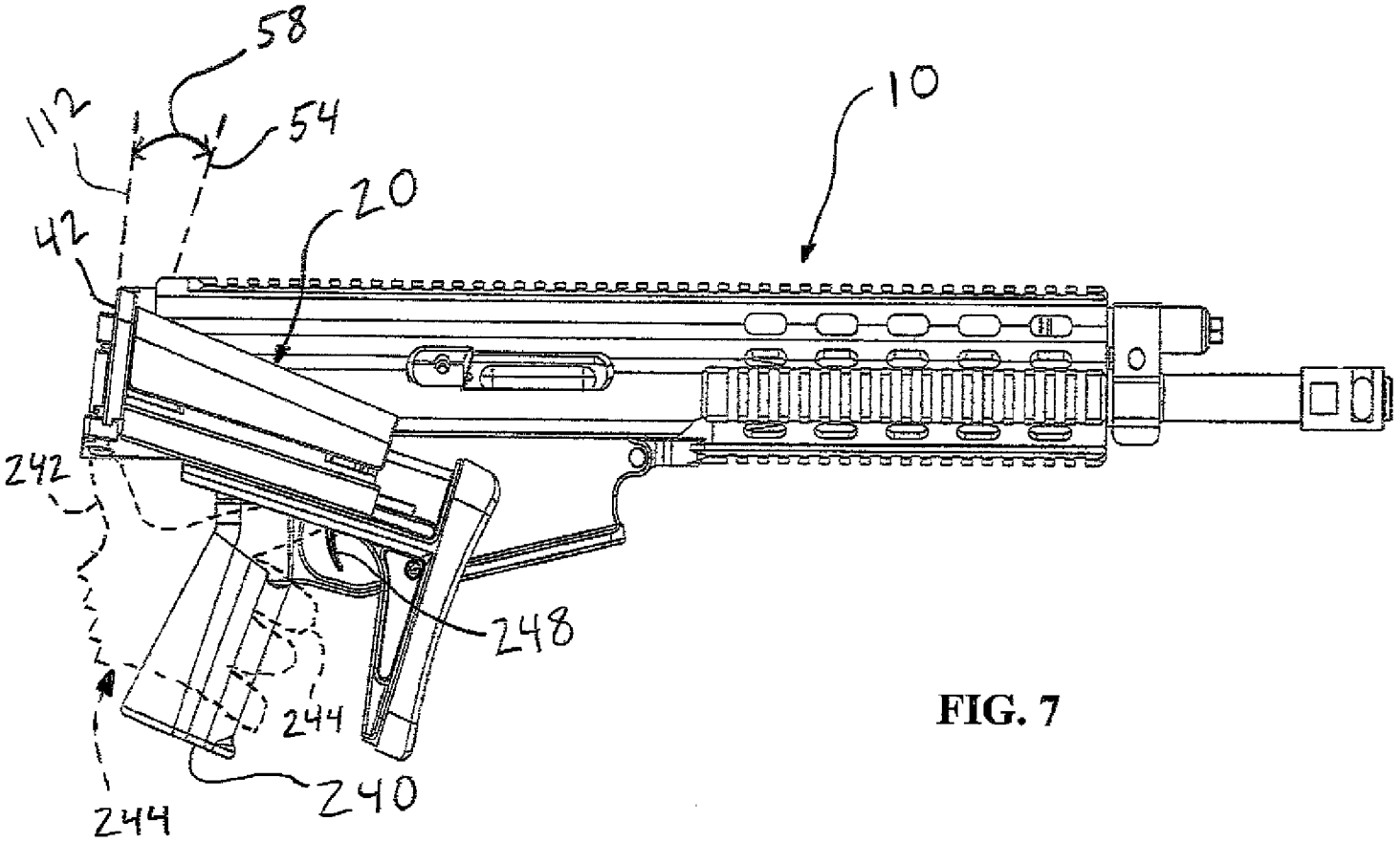
FIG. 7 illustrates the adjustable stock 20 of FIG. 1 disposed in the folded position.

FIG. 7 illustrates the adjustable stock 20 of FIG. 1 disposed in the folded position. As shown in the folded configuration, the reciprocal abutment surface 42 and the pivot axis 112 may be disposed at the same angle 58 to the vertical axis 54 of the stock body 50.

Additionally shown, the push surface 114 is disposed within reach of a pistol grip 240 of the firearm 10 so that a user can actuate the push surface 114 to move the adjustable stock 20 between the folded position and aligned position with their thumb 242 while keeping their fingers 244 of their hand 246 (shown in dotted line) in engagement with the pistol grip 240 and a trigger 248. Consequently, a user may be able to faster respond to a situation while moving the adjustable stock 20 between the folded position and aligned position.

INDUSTRIAL APPLICABILITY

In general, embodiments of the present disclosure relate to an adjustable stock for use with a firearm. The adjustable stock as disclosed permits a user to move the stock between a folded position and an aligned position by actuating a push surface of the hinge pin to disengage retention features of an attachment member and a stock member. When the push surface is disposed close to a pistol grip of a firearm a user may actuate the push surface with a thumb while the fingers of the same hand may be in engagement with the pistol grip and potentially a trigger of the firearm.

Additional features that may be incorporated with other folding stock designs, include disposing a plurality of stock attachment locations on the stock member and/or the housing of the stock body. Consequently the location of the hosing relative to the stock member may be adjusted. When the plurality of stock attachment locations are vertically oriented, the adjustment may be made vertically, which may permit a user to position the stock body to properly support their line of sight through the sites of the firearm.

Further, the cheek piece may also be vertically adjusted to provide even greater vertical adjustment. The cheek piece may include a plurality of protrusions that are disposed within the channels of the housing of the stock body to connect the cheek piece to the housing. Unintentional separation of the cheek piece from the housing maybe prevented through a detent and a detent recess or alternatively through use of a cheek piece retainer that engages one of the protrusions to prevent removal of the protrusion from the channel of the housing. Of course, the cheek piece and housing design may be used separately on other stock designs.

The design components described herein may be used together or separately in a stock design to provide adjustment of a stock to better fit the different features of different users.

What is claimed is:

1. A stock for a firearm, comprising:

an attachment member shaped to attach the stock to a firearm;

a fastener;

a stock member pivotally attached to the attachment member, wherein the stock member is pivotable between an aligned position and a folded position, wherein the stock member includes a plurality of stock attachment locations that are each sized to receive the fastener; and a stock body, wherein the stock body includes a plurality of stock attachment locations that are each sized to receive the fastener, wherein the stock member and stock body are connected together by the fastener extending through one of the plurality of stock attachment locations of the stock member and one of the plurality of stock attachment locations of the stock body, wherein the plurality of stock attachment locations permit vertical adjustment of the stock body relative to the stock member.

2. The stock of claim 1, wherein the plurality of stock attachment locations include a top stock attachment location and a bottom stock attachment location.

3. The stock of claim 1, wherein the plurality of stock attachment locations are disposed in a recessed surface of the stock member, the stock further comprising a fastener extending through one of the plurality of stock attachment locations of the stock member into a stock attachment location of the stock body to connect the stock body to the stock member.

4. The stock of claim 1, wherein the stock body is an assembly including:

a housing including a plurality of channels;

a telescoping frame selectively fixable at one of a plurality of housing positions; and a cheek piece including a protrusion, wherein the protrusion is disposed in one of the plurality of channels to position the cheek piece at one of a plurality of heights relative to the housing.

5. The stock of claim 4, wherein the housing includes a cheek piece retainer disposed to selectively retain the protrusion in at least one of the plurality of channels.

6. The stock of claim 5, wherein the cheek piece retainer includes an actuation surface that is disposed beneath the outer surface of the housing.

7. The stock of claim 5, wherein the cheek piece retainer is disposed to selectively prevent the telescoping frame from being disconnected from the housing.

8. The stock of claim 1, wherein the stock body defines a vertical axis, the attachment member having an abutment surface and the stock member having a reciprocal abutment surface, wherein when the stock member is disposed in the aligned position, the abutment surface abuts the reciprocal abutment surface and the abutment surface and the reciprocal abutment surface are disposed at a negative angle relative to the axis.

9. The stock of claim 8, wherein the angle is in the range of 1 to 10 degrees.

10. The stock of claim 9, wherein the angle is in the range of 3 to 7 degrees.

11. The stock of claim 1, further comprising a butt stock pad connected to the stock body, wherein the plurality of stock attachment locations permit vertical adjustment of the stock body and the butt stock pad relative to the stock member and the attachment member.

12. The stock of claim 1, wherein the stock member is pivotally connected to the attachment member via a pin and pivots about a pivot axis, the pin including a push surface, wherein when the stock member and the attachment member are in the aligned position and the push surface is actuated, the pin and the stock member are moved along the pivot axis to permit the stock member to be pivoted from the aligned position.

13. The stock of claim 1, further comprising a second fastener extending through one or more of the plurality of stock attachment locations of the stock member and one of the plurality of stock attachment locations of the stock body to connect the stock member and the stock body.

* * * * *